US008267807B2

(12) United States Patent
Takechi et al.

(10) Patent No.: US 8,267,807 B2
(45) Date of Patent: Sep. 18, 2012

(54) IRON GOLF CLUB HEAD

(75) Inventors: Takaharu Takechi, Shinagawa-ku (JP); Daisuke Horii, Shinagawa-ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 153 days.

(21) Appl. No.: 12/846,290

(22) Filed: Jul. 29, 2010

(65) Prior Publication Data

US 2011/0028236 A1 Feb. 3, 2011

(30) Foreign Application Priority Data

Aug. 3, 2009 (JP) ..... 2009-180778

(51) Int. Cl.
*A63B 53/04* (2006.01)

(52) U.S. Cl. ..... 473/332; 473/335; 473/338; 473/342; 473/350

(58) Field of Classification Search ..... 473/324–350, 473/287–292
See application file for complete search history.

(56) References Cited

U.S. PATENT DOCUMENTS

| | | | | |
|---|---|---|---|---|
| 2,846,228 | A | 8/1958 | Reach | |
| 3,749,408 | A * | 7/1973 | Mills | 473/336 |
| 4,883,274 | A | 11/1989 | Hsien | |
| 4,928,972 | A * | 5/1990 | Nakanishi et al. | 473/332 |
| 5,104,457 | A | 4/1992 | Viljoen et al. | |
| 5,308,062 | A * | 5/1994 | Hogan | 473/292 |
| 5,316,298 | A | 5/1994 | Hutin et al. | |
| 5,409,229 | A | 4/1995 | Schmidt et al. | |
| 5,588,923 | A | 12/1996 | Schmidt et al. | |
| 5,605,511 | A | 2/1997 | Schmidt et al. | |
| 5,626,530 | A | 5/1997 | Schmidt et al. | |
| 5,704,849 | A | 1/1998 | Schmidt et al. | |
| 5,776,010 | A | 7/1998 | Helmstetter et al. | |
| 5,993,331 | A * | 11/1999 | Shieh | 473/342 |
| 6,835,144 | B2 * | 12/2004 | Best | 473/332 |
| 7,384,348 | B2 * | 6/2008 | Lin et al. | 473/332 |
| 7,387,579 | B2 * | 6/2008 | Lin et al. | 473/332 |
| 7,481,719 | B2 * | 1/2009 | Imamoto | 473/332 |
| 7,819,757 | B2 * | 10/2010 | Soracco et al. | 473/332 |
| 2007/0155538 | A1 * | 7/2007 | Rice et al. | 473/342 |

FOREIGN PATENT DOCUMENTS

| | | | |
|---|---|---|---|
| JP | 52-108159 | U | 8/1977 |
| JP | 07-148291 | A | 6/1995 |
| JP | 2000-093564 | A | 4/2000 |
| JP | 2000-293124 | A | 10/2000 |
| WO | 93/20904 | A1 | 10/1993 |

* cited by examiner

*Primary Examiner* — Sebastiano Passaniti
(74) *Attorney, Agent, or Firm* — Sughrue Mion, PLLC

(57) ABSTRACT

An iron golf club head has a faceplate for hitting a golf ball, the faceplate having a back face; a viscoelastic body fixed onto the back face of the faceplate; and a backplate for sandwiching the viscoelastic body with the faceplate, the backplate having a flange that extends out of the periphery of the viscoelastic body and is fixed onto the back face of the faceplate.

18 Claims, 4 Drawing Sheets

IRON GOLF CLUB HEAD

CROSS-REFERENCE TO RELATED APPLICATION

This application claims priority of Japanese Patent Application No. 2009-180778 filed Aug. 3, 2009, which is incorporated herein by reference in its entirety.

BACKGROUND OF THE INVENTION

The present invention relates to an iron golf club head, and in particular, relates to an iron golf club head in which a viscoelastic body is disposed on and attached to a back face of a faceplate thereof.

An iron golf club head at least includes a faceplate for hitting a golf ball, a sole, and a hosel. A shaft is inserted into and fixed to the hosel, thereby constituting an iron golf club.

In order to absorb the impact or vibration generated in a golf club head when the ball is hit by the golf club, a viscoelastic material such as rubber may be attached to the golf club head or may be embedded in a hollow portion of the golf club head.

Japanese Patent Application Publication No. 06-510689 discloses that an elliptical viscoelastic sheet made of butyl rubber and having a diameter of major axis of 45 mm, a diameter of minor axis of 18 mm, and a thickness of 1 mm is bonded to a back face of a faceplate. This patent document also discloses that a nameplate made of an aluminum-zinc-magnesium alloy having a thickness of 1 mm is bonded to the viscoelastic body.

However, as disclosed in the patent document, the viscoelastic sheet and the nameplate have the same size. For this reason, the edge face of the viscoelastic sheet is exposed to the atmosphere, so that it may be prone to deterioration, for example, by water or ultraviolet radiation, or so that it may peel from the back face of the faceplate. Also, the viscoelastic sheet may lack a vibration absorbing effect because the viscoelastic sheet absorbs only vibration directly propagated from the faceplate.

SUMMARY OF THE INVENTION

The present invention has as an object to provide an iron golf club head having good adhesion durability of a viscoelastic sheet opposing a faceplate and an excellent vibration-absorption effect.

The present invention provides an iron golf club head including a faceplate for hitting a golf ball, the faceplate having a back face; a viscoelastic body fixed onto the back face of the faceplate; and a backplate for sandwiching the viscoelastic body with the faceplate, the backplate having a flange that extends out of the periphery of the viscoelastic body and is fixed onto the back face of the faceplate.

The viscoelastic body may be disposed at the center part of the back face of the faceplate.

The backplate may include a recessed part for holding the viscoelastic body. The flange of the backplate may extend out of the entire periphery of the recessed part.

The flange may include a heel-side part extending from the recessed part to the heel side of the head and a toe-side part extending from the recessed part to the toe side of the head. The viscoelastic body and the flange of the backplate may be bonded onto the back face of the faceplate by adhesive, respectively.

The backplate may be made of a metal plate having a thickness of about 0.2 mm to about 0.4 mm.

The backplate may be manufactured by electroforming or press forming.

The viscoelastic body may include at least one thick-material part and at least one thin-material part, the at least one thick-material part being disposed at an outside of the at least one thin-material part.

According to the present invention, the viscoelastic body is fixed onto the back face of the faceplate, and also the backplate covers the viscoelastic body. The backplate has a flange extending out of the periphery of the viscoelastic body and fixed onto the back face of the faceplate. The viscoelastic body is, therefore, fully covered so as to be sealed by the backplate, so that it is not exposed to the atmosphere. For this reason, water does not splash thereon, and ultraviolet radiation does not directly strike, the viscoelastic body, and as a result, the durability of the viscoelastic body and durability of the adhesion of the viscoelastic body to the back face are good.

According to the present invention, since the flange of the backplate is fixed onto the faceplate, when a ball is hit (at the time of a golf shot), a part of the vibration generated in a peripheral portion of the faceplate propagates to the viscoelastic body through the backplate, so as to be absorbed. For this reason, the golf club head according to the present invention has an excellent vibration-absorbing effect.

In the case in which the viscoelastic body is housed in the recessed part of the backplate, it is possible to hold the viscoelastic body securely.

By the flange extending out of the entire periphery of the recessed part, the viscoelastic body can be held very securely to the faceplate.

By the heel-side and toe-side parts of the flange extending to the heel and toe sides, respectively, vibration in the case of hitting at the heel side or the toe side of the faceplate can easily propagate through the viscoelastic body, and the vibration-absorption effect is high.

In the case in which the viscoelastic body includes at least one thin-material part and at least one thick-material part disposed at an outside of the at least one thin-material part, vibrations at various frequencies can be absorbed. Furthermore, by disposing the thick-material part on the periphery of the viscoelastic body, vibration which is propagated from the peripheral portion of the viscoelastic body through the backplate is effectively absorbed by the thick-material part.

BRIEF DESCRIPTION OF THE DRAWINGS

FIG. 5(*b*) is a cross-sectional view taken along line B-B in FIG. 5(*a*)

DETAILED DESCRIPTION OF THE PREFERRED EMBODIMENT

Figure 1:
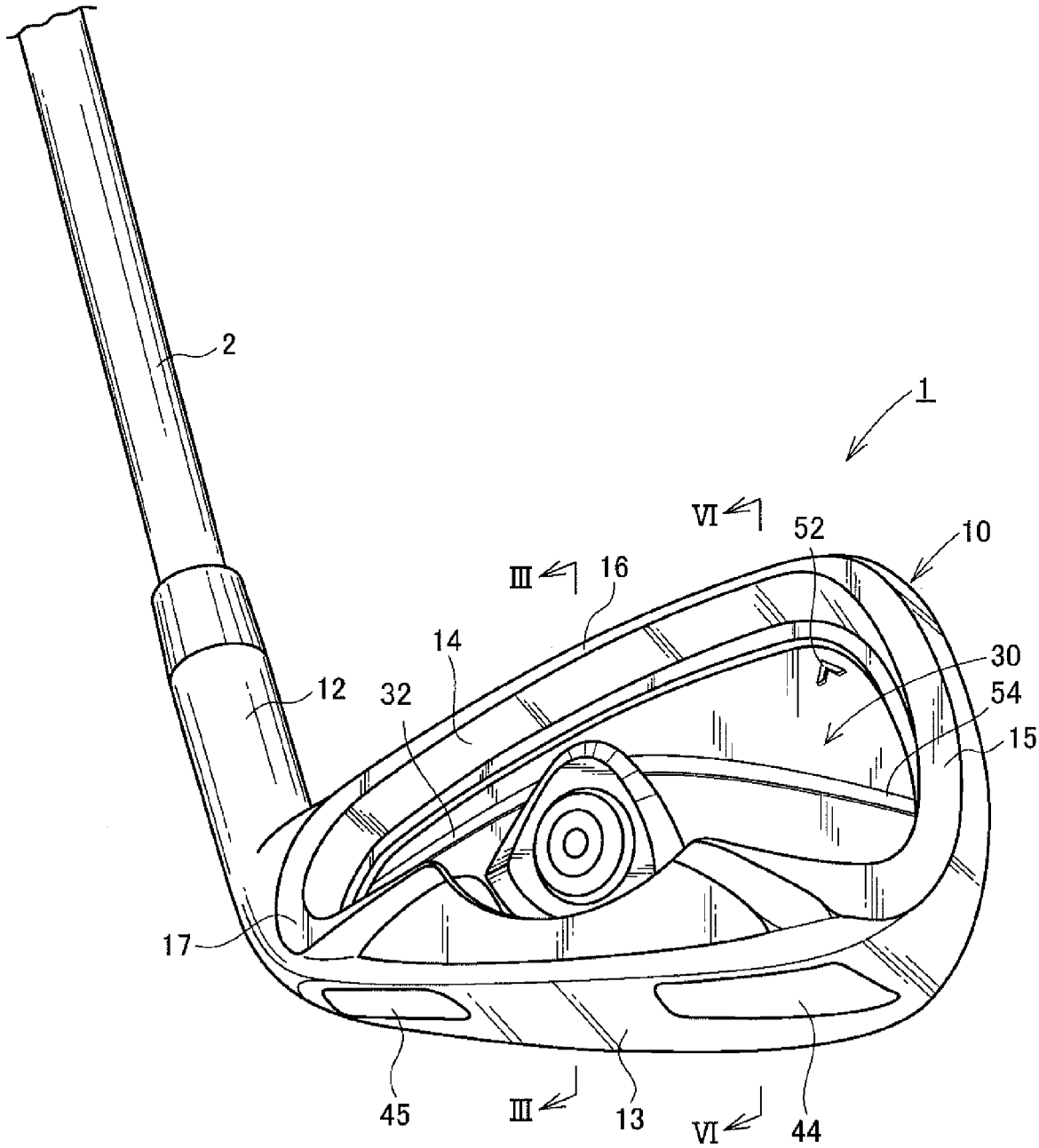
FIG. 1 is a perspective view of an iron golf club head according to an embodiment of the present invention from the sole side and the rear face side thereof.

An embodiment of an iron golf club head in accordance with the present invention will now be described in more detail with reference to FIGS. 1 to 6.

An iron golf club head 1 is to be mounted on a tip of a shaft 2 of an iron golf club. The golf club head 1 includes a golf club head body 10, a viscoelastic body 20 fixed to a back face of a faceplate 11 of the golf club head body 10, and a nameplate (or backplate) 30 which covers the viscoelastic body 20 and is fixed to the back face of the faceplate 11.

The golf club head body 10 includes the faceplate 11, a hosel 12, and a sole 13. The faceplate 11 has a cavity 14 on the back face side thereof. The cavity 14 extends from a toe side to a heel side (i.e., a player's side). The periphery of the cavity 14 is surrounded by the sole 13, a toe-side protrusion 15, a top-side protrusion 16 and a heel-side protrusion 17, these protrusions 15-17 being backwardly protruding from the peripheral portion of the faceplate 11. The back face of the faceplate 11 is a flat surface except in the neighborhood of the protrusions 15-17 and the sole 13.

Figure 2:
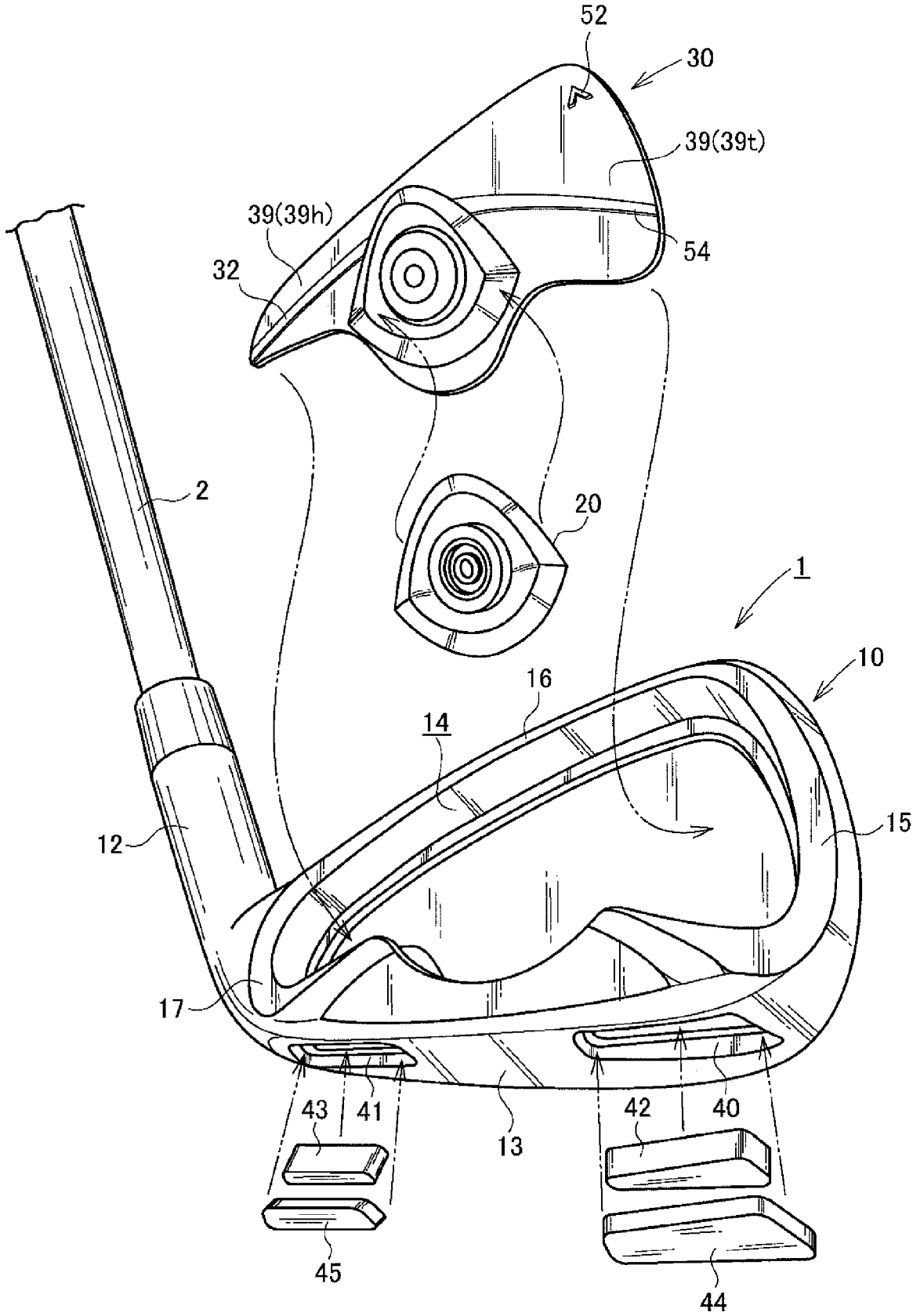
FIG. 2 is an exploded perspective view of the iron golf club head shown in FIG. 1.

In this embodiment, as shown in FIG. 2, the sole 13 has holes 40, 41 on the base surface (i.e., the sole surface) in a toe side and a heel side thereof. Vibration-absorbing materials 42, 43 made of rubber or elastomer, are filled into the recesses of the holes 40, 41. Each of the holes 40, 41 has a widened opening part having a larger cross-sectional area than the recess of the hole. Weighting materials 44, 45 are fitted into the widened parts of the holes 40, 41. The weighting materials 44, 45 are made of a high-density metallic material such as tungsten and alloys thereof. The high-density metallic material has a specific gravity of at least 10 and more preferably at least 12. The weighting materials 44, 45 are fixed to the golf club head body 10 by using laser welding or by crimping.

As a rubber or an elastomer for the vibration-absorbing materials 42, 43, for example, a mixed rubber of natural rubber and bromide butyl or chlorobutyl rubber, acrylnitril butadien rubber (NBR), silicone rubber, styrene elastomer, olefinic elastomer, urethane elastomer, ester elastomer and amide elastomer are preferable, among which NBR is more preferable.

Figure 5A:
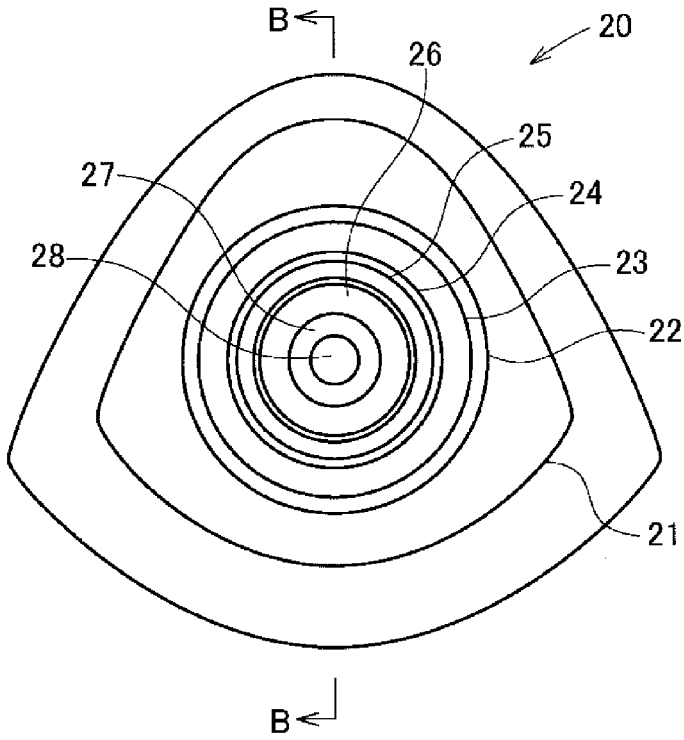
FIG. 5(*a*) is a back view of a viscoelastic body of the iron golf club head shown in FIG. 1.
Figure 5B:
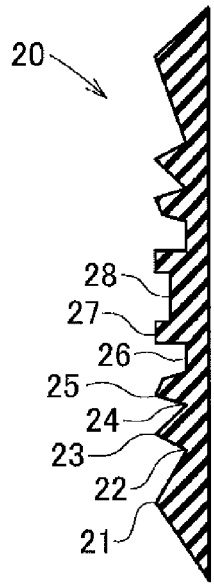

As shown in FIG. 5, the viscoelastic body 20 is a thin plate member having a substantially round shape. Materials for the viscoelastic body 20 are preferably rubber or elastomer having viscoelasticity.

As rubber or elastomer for the viscoelastic body 20, the materials listed above for the vibration-absorbing materials 42, 43 can be used. In particular, NBR is more preferable.

The viscoelastic body 20 has a flat surface on a side to the faceplate 11. As shown in FIGS. 5(*a*) and 5(*b*), on a side opposite to the faceplate 11 (i.e., on a rear face), the viscoelastic body 20 has a first ridge 21, a first groove 22, a second ridge 23, a second groove 24, a third ridge 25, a third groove 26, and a fourth ridge 27, which are formed in circular patterns, respectively, and are arranged substantially concentrically in sequence from the periphery thereof. The viscoelastic body 20 has a round depression 28 at the central portion thereof.

The viscoelastic body 20 has an average thickness of about 0.5 mm to about 2.5 mm, and preferably about 0.8 mm to about 1.5 mm.

The viscoelastic body 20 has a maximum length from top to bottom of about 10 mm to about 30 mm, and preferably about 18 mm to about 28 mm. The viscoelastic body 20 has a maximum width from left to right of about 15 mm to about 35 mm, and preferably about 20 mm to about 30 mm.

Figure 3:
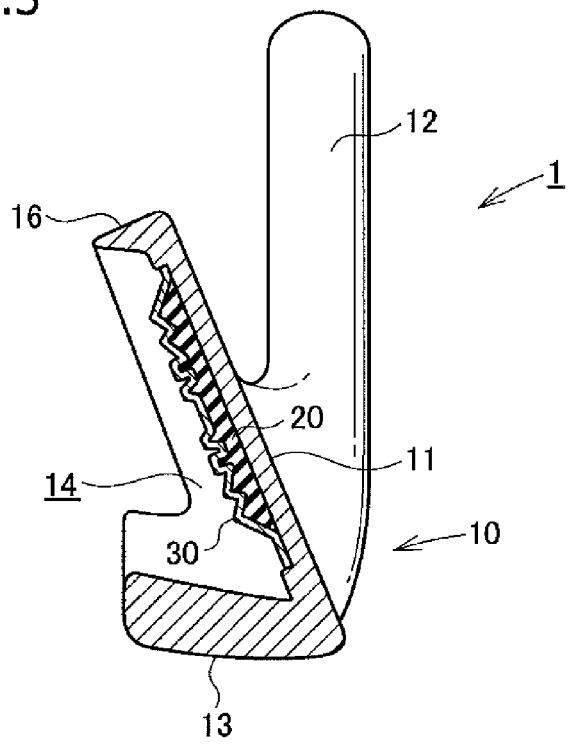
FIG. 3 is a cross-sectional view taken along line III-III in FIG. 1.

The nameplate 30 has a size sufficient to extend from a toe end to a heel end and from a top end to a sole end of the back face of the faceplate 11. As shown in FIG. 3, the nameplate 30 has a recessed part having a shape and size to fit closely with the ridge and groove surface of the viscoelastic body 20 at a middle part along the toe-to-heel direction thereof.

Figure 4:
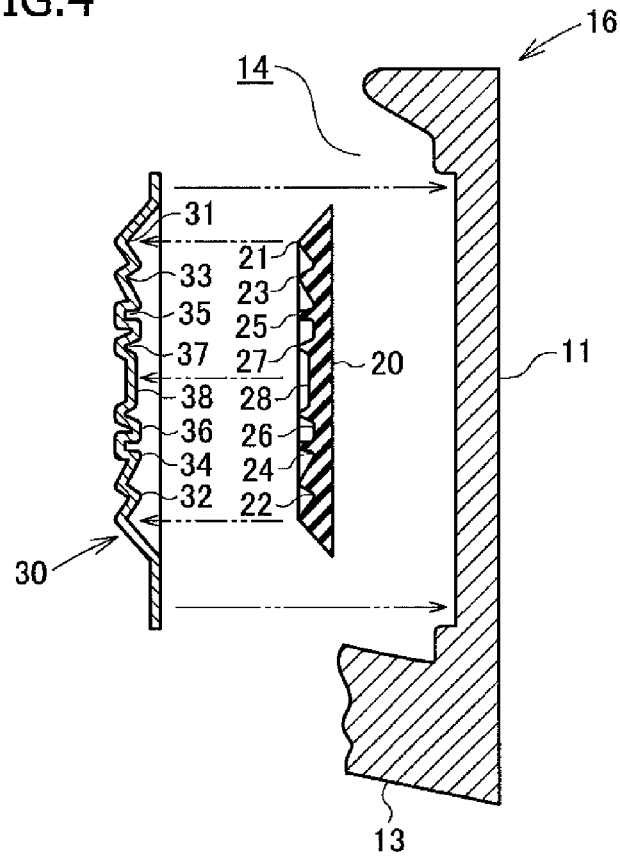
FIG. 4 is an exploded cross-sectional view of the iron golf club head shown in FIG. 3.

As shown in FIG. 4, the recessed part of the nameplate 30 includes a first groove 31 to be mated with the first ridge 21, a first ridge 32 to be mated with the first groove 22, a second groove 33 to be mated with the second ridge 23, a second ridge 34 to be mated with the second groove 24, a third groove 35 to be mated with the third ridge 25, a third ridge 36 to be mated with the third groove 26, and a fourth groove 37 to be mated with the fourth ridge 27 of the viscoelastic body 20. These grooves and ridges 31-37 are arranged substantially concentrically. The recessed part also includes a round projection 38 to be mated with the depression 28 at the central portion thereof.

In the state in which the ridge and groove surface of the viscoelastic body 20 fits with the recessed part of the nameplate 30, the opposite surface of the viscoelastic body 20 becomes flush with a surrounding surface of the recessed part of the nameplate 30.

The nameplate 30 has a flange 39 surrounding the recessed part and extending in a long manner towards a toe side and a heel side thereof, as shown in FIG. 2. A toe-side part of the flange 39*t* extends up to the proximity of the toe-side protrusion 15 of the golf club head body 10. A heel-side part of the flange 39*h* extends up to the proximity of the heel-side protrusion 17. The flange 39 has a flush surface at a side to the faceplate 11. On the opposite surface, the flange 39 has one or more raised and/or lowered patterns such as letters, graphics, and symbols so as to represent a company name, a product name, or a trademark, for example, a raised logo 52 representing a letter "V," as shown in FIGS. 1 and 2. Also, the flange 39 may have one or more raised and/or lowered decorative patterns such as straight, curved or zigzag lines, and grids on the exposed surface, for example, a raised line 54 extending a toe side to a heel side of the nameplate 30 except a central part having the grooves and ridges 31-37, as shown in FIGS. 1 and 2. The raised and/or lowered decorative patterns prevent the nameplate 30 from deforming.

The nameplate 30 is preferably made of a metal material having a thickness of about 0.2 mm to about 0.4 mm, and in particular, about 0.3 mm.

The nameplate 30 may be manufactured by electroforming, in which plating techniques may be applied, or by press forming.

In the case in which the nameplate 30 is manufactured by electroforming, as a base material for the nameplate 30, a metal such as copper, nickel, chromium, zinc, gold, silver, rhodium, and a nickel-phosphorus alloy is preferable. In particular, nickel is more preferable. After a substrate of the nameplate 30 is made of the base material, the surface of the substrate may be covered with a metal, by plating, which is harder than a metal used for the base material. For example, the surface of a substrate made of nickel may be covered with chromium by plating. This plating can prevent the nameplate 30 from being damaged. Also, a part of the surface of the substrate may be plated to vary the coloration of the nameplate 30.

In the case in which the nameplate 30 is manufactured by press forming, as a material for the nameplate 30, a metal such as aluminum, an aluminum alloy, titanium, a titanium alloy, and stainless steel is preferable, because aluminum and an aluminum alloy are ductile, and stainless steel resists rusting. A substrate made of aluminum, an aluminum alloy, titanium or a titanium alloy may be anodized.

Figure 6:
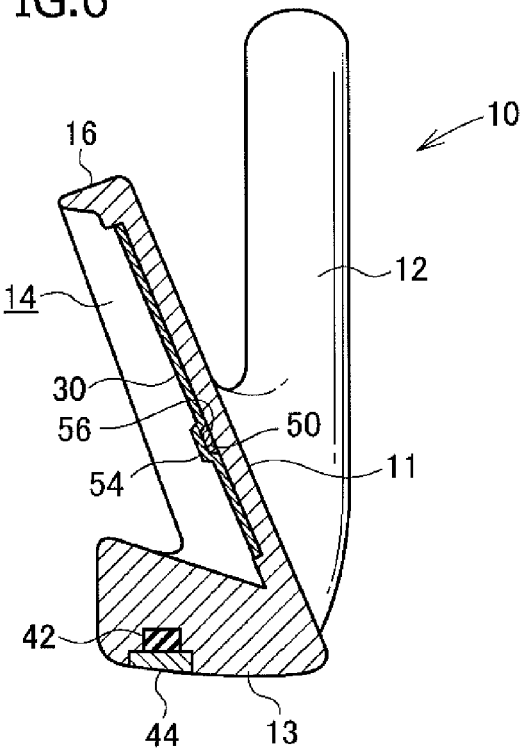
FIG. 6 is a cross-sectional view taken along line VI-VI in FIG. 1.

After the viscoelastic body 20 is fitted into the recessed part of the nameplate 30, the flange 39 of the nameplate 30 and the viscoelastic body 20 are attached to the back face of the faceplate 11 using an adhesive such as a pressure-sensitive adhesive, e.g., a double-sided tape. As shown in FIG. 6, the nameplate 30 has a recessed part 56 on the surface opposite to the raised pattern 54. The recessed part 56 for the raised pattern 54 is filled with a hard plastic body 50 made of a rigid resin such as epoxy and polyester, or a rigid foam such as a rigid polyurethane foam. The hard plastic body 50 can prevent the raised pattern 54 from denting or breaking. Also, the hard plastic body 50 can increase adhesion between the nameplate 30 and the faceplate 11, because the hard plastic body 50 sticks to the recessed part 56 of the nameplate 30 and forms a flat surface with a surrounding surface of the recessed part of the nameplate 30. Also, the nameplate 30 has a recessed part (not shown) on the surface opposite to the raised logo 52. This recessed part is also filled with a hard plastic body (not shown).

An iron golf club is manufactured by inserting the shaft 2 into the hosel 12 of the golf club head 1 and fixing them using an adhesive.

This golf club head 1 includes the viscoelastic body 20 fixed onto the back face of the faceplate 11, and the nameplate 30 that covers the viscoelastic body 20 and that has the flange 39 protruding toward the periphery of the viscoelastic body and being attached onto the back of the faceplate 11, and thus, the viscoelastic body 20 is hermetically sealed by the nameplate 30 so as not to be exposed to the atmosphere. For this reason, water does not splash onto the viscoelastic body 20 and ultraviolet radiation does not strike it directly and, as a result, the durability of the viscoelastic body 20 and the durability of the adhesion of the viscoelastic body 20 to the back face of the faceplate 11 are good.

The viscoelastic body 20 is fitted and mated into a recessed part that is provided in the nameplate 30, so that the viscoelastic body is held securely to the back face of the faceplate. Because the flange 39 is provided around the entire peripheral recessed part, the viscoelastic body 20 can be firmly sealed and held to the faceplate 11.

Since the heel-side flange 39*h* and the toe-side flange 39*t* constituting a part of the flange extend at the heel side and the toe side, vibration in the case of hitting a ball at the heel side or the toe side of the faceplate 11 can easily propagate through the viscoelastic body 20, so that the vibration-absorbing effect is high.

In this viscoelastic body 20, because the ridges 21, 23, 25, 27 are thick-material parts, and the grooves 22, 24, 26 and the depression 28 are thin-material parts, vibration at various frequencies can be effectively absorbed. Furthermore, by making the outer peripheral portion to be the thick ridge 21, vibration that is propagated through the flange 39 of the nameplate 30 from the peripheral portion of the viscoelastic body 20 is effectively absorbed by the thick-material part of the ridge 21.

Although the invention has been described in connection with a preferred embodiment, it is not intended to limit the scope of the invention to the particular form set forth, and it is instead intended to cover such alternatives, modifications, and equivalents as may be included within the spirit and scope of the invention as defined by the appended claims.

What is claimed is:

1. An iron golf club head comprising:

a faceplate for hitting a golf ball, the faceplate having a back face;

a viscoelastic body fixed onto the back face of the faceplate; and a backplate for sandwiching the viscoelastic body with the faceplate, the backplate having a flange that extends out of the periphery of the viscoelastic body and is fixed onto the back face of the faceplate, wherein the backplate comprises a recessed part for holding the viscoelastic body, and the flange of the backplate extends out of the entire periphery of the recessed part, wherein the flange comprises a heel-side part extending from the recessed part to the heel side of the head and a toe-side part extending from the recessed part to the toe side of the head.

2. The iron golf club head according to claim 1, wherein the viscoelastic body is disposed at the center part of the back face of the faceplate.

3. The iron golf club head according to claim 1 wherein the viscoelastic body and the flange of the backplate are bonded onto the back face of the faceplate by adhesive, respectively.

4. The iron golf club head according to claim 1, wherein the backplate is made of a metal plate having a thickness of about 0.2 mm to about 0.4 mm.

5. The iron golf club head according to claim 1, wherein the backplate is manufactured by electroforming.

6. The iron golf club head according to claim 1, wherein the backplate is manufactured by press forming.

7. The iron golf club head according to claim 1, wherein the viscoelastic body comprises at least one thick-material part and at least one thin-material part, the at least one thick-material part being disposed at an outside of the at least one thin-material part.

8. The iron golf club head according to claim 1, wherein the viscoelastic body is covered so as to be sealed by the backplate.

9. The iron golf club head according to claim 1, wherein the toe-side part of the flange extends up to the proximity of a toe-side protrusion of the golf club head body, and the heel-side part of the flange extends up to the proximity of a heel-side protrusion of the golf club head body.

10. The iron golf club head according to claim 1, wherein the flange has a flush surface at a side facing the faceplate.

11. The iron golf club head according to claim 1, wherein the viscoelastic body is a plate member having a substantially round shape.

12. The iron golf club head according to claim 11, wherein the viscoelastic body comprises plural concentric ridges and grooves on a side facing the backplate.

13. The iron golf club head according to claim 11, wherein the viscoelastic body comprises a depression in a central portion of a side facing the backplate.

14. The iron golf club head according to claim 1, wherein the viscoelastic body has a flat surface on a side facing the faceplate.

15. The iron golf club head according to claim 1, wherein the recessed part of the backplate has a profile that conforms to a surface of the viscoelastic body on a side facing the backplate.

16. An iron golf club head comprising:

a faceplate for hitting a golf ball, the faceplate having a back face;

a viscoelastic body disposed at a center part of the back face of the faceplate, the viscoelastic body being a plate member having a substantially round shape; and a backplate for sandwiching the viscoelastic body with the faceplate, the backplate having a flange that extends out of the periphery of the viscoelastic body and is fixed onto the back face of the faceplate, wherein the backplate comprises a recessed part for holding the viscoelastic body, and the flange of the backplate extends out of the entire periphery of the recessed part, wherein the flange comprises a heel-side part extending from the recessed part to the heel side of the head and a toe-side part extending from the recessed part to the toe side of the head, wherein the toe-side part of the flange extends up to the proximity of a toe-side protrusion of the golf club head body, and the heel-side part of the flange extends up to the proximity of a heel-side protrusion of the golf club head body.

17. The iron golf club head according to claim 16, wherein the viscoelastic body and the flange of the backplate are bonded onto the back face of the faceplate by adhesive, respectively, and wherein the viscoelastic body is covered so as to be sealed by the backplate.

18. The iron golf club head according to claim 16, wherein the viscoelastic body comprises plural concentric ridges and grooves on a side facing the backplate.

* * * * *